US006364177B1

(12) United States Patent
Taylor

(10) Patent No.: US 6,364,177 B1
(45) Date of Patent: Apr. 2, 2002

(54) ACCESSORIES FOR USE WITH AEROSOL CONTAINERS

(75) Inventor: Gerald Maurice Taylor, Maulden (GB)

(73) Assignee: Item Products (NPD) Limited, Bedfordshire (GB)

( * ) Notice: Subject to any disclaimer, the term of this patent is extended or adjusted under 35 U.S.C. 154(b) by 0 days.

(21) Appl. No.: 09/653,028

(22) Filed: Sep. 1, 2000

(51) Int. Cl.[7] ..... A47G 19/00
(52) U.S. Cl. ..... 222/473; 222/402.15
(58) Field of Search ..... 222/402.13, 402.15, 222/473, 527

(56) References Cited

U.S. PATENT DOCUMENTS

| | | | | |
|---|---|---|---|---|
| 2,899,108 A | * | 8/1959 | Knapp | 222/402.15 |
| 3,716,195 A | | 2/1973 | Silva | 239/375 |
| 4,089,440 A | | 5/1978 | Lee | 222/174 |
| 4,805,812 A | * | 2/1989 | Brody | 222/402.15 |
| 4,826,054 A | * | 5/1989 | Frutin | 222/402.13 |
| 5,518,148 A | | 5/1996 | Smrt | 222/174 |
| 5,755,363 A | | 5/1998 | Gantner et al. | 222/402.15 |
| 6,003,740 A | * | 12/1999 | Castanda, Jr. | 222/402.15 |

FOREIGN PATENT DOCUMENTS

| | | |
|---|---|---|
| DE | 801 838 | 6/1970 |
| DE | 8611 458.1 | 6/1996 |
| GB | 2011549 A | 7/1979 |
| GB | 2348929 A | 10/2000 |
| WO | WO 92/07600 | 5/1992 |

* cited by examiner

*Primary Examiner*—Kevin Shaver
*Assistant Examiner*—Thach H. Bui
(74) *Attorney, Agent, or Firm*—Woodcock Washburn LLP

(57) ABSTRACT

An accessory for an aerosol container intended for use in an inverted attitude comprises a cradle to support the container and a lever and cam actuating mechanism to effect opening of the aerosol valve. The cradle comprises two clips detachably fitted to a pistol-type hand grip. The actuating mechanism comprises a double-armed trigger and a pivotable double-armed toggle in engagement therewith. Squeezing of the trigger causes a thrust surface or surfaces of the toggle to press against the nozzle of the container and open the valve.

8 Claims, 3 Drawing Sheets

ACCESSORIES FOR USE WITH AEROSOL CONTAINERS

FIELD OF THE INVENTION

This invention relates generally to accessories for use with aerosol containers, and is particularly concerned with dispensing mechanisms for such containers.

DESCRIPTION OF THE PRIOR ART

GB-B-2218471 describes a dispensing mechanism for an aerosol container, which comprises a pistol-type grip, with trigger, having a bifurcated arm which engages around the neck of the container, and wherein the trigger is linked to an actuating member which upon operation of the trigger is arranged to depress the button of the container and hence eject a spray. This dispensing mechanism is intended for use with relatively small size aerosol containers which are designed to be held in a generally upright position in use.

Also known are larger-size, heavy duty aerosol containers which are intended for use in an inverted attitude, i.e. for use with the nozzle pointing downwards towards the ground. Such containers are used for example for the spraying of black bitumastic paint or white liner paints, such as on sports grounds and the like. However, it is to be emphasised that the present invention is not limited to aerosol containers of any particular type or to the use of any particular contents. Various mechanisms are known for the dispensing of the product from such heavy duty containers. These are generally based upon the use of a mobile trolley or the like on which the container is mounted in an inverted attitude. However, such mechanisms are expensive and not easy to operate.

It is of course possible to dispense the contents of such heavy duty containers just by holding the container and manually depressing the valve mechanism. However, that is often difficult from a practical point of view and there is considerable risk of the contents of the container contaminating the hands of the user.

U.S. Pat. No. 5,755,363 describes a device for dispensing a flowable mass stored under pressure in a container, where manual operation of a trigger causes direct actuation of an outlet valve. The squeezing of the trigger in a generally horizontal direction directly causes upward movement of an elbow piece on the stem of the outlet valve.

SUMMARY OF THE INVENTION

It is an object of the present invention to provide a simple, low-cost but effective mechanism for the dispensing of the contents of an aerosol container in an inverted attitude.

It is a further object of the present invention to provide an improved dispensing mechanism for a heavy duty aerosol container which can readily be adapted for use with a variety of different aerosol valve mechanisms and nozzles.

In accordance with the present invention there is provided an accessory for dispensing the contents of an aerosol container, comprising support means for the container, a manually operable trigger which is displaceable relative to the support means, and a lever mechanism in engagement with the trigger and having at least one thrust surface for engagement with a valve-actuating mechanism of the container, the trigger and lever mechanism being arranged such that movement of the trigger in a direction to actuate the valve produces a movement of said at least one thrust surface in substantially the same direction.

Preferably, the trigger is pivotable relative to the support means, and the lever mechanism is pivotally displaceable by movement of the trigger.

Preferably, the trigger is one arm of a first double-armed lever, the other arm of which is in camming engagement with an arm of a second double-armed lever, the other arm of which defines said at least one thrust surface.

In a preferred embodiment, the other arm of the first double-armed lever is formed as a nose engageable between fingers defined by the second double-armed lever.

In a preferred embodiment, two thrust surfaces are provided, one arranged to act on each side of a nozzle of the container.

Preferably, the support means comprises a cradle for a general cylindrical container having a longitudinal axis, a hand-grip is connected to the cradle and projects generally radially outwardly from the container axis, and the trigger in its inoperative position also projects generally radially outwardly from the container.

In one embodiment, the cradle comprises two clips each subtending a pair of arcuate arms engageable around the container, with the clips each being detachably connected to the hand-grip.

BRIEF DESCRIPTION OF THE DRAWINGS

In order that the invention may be more fully understood, two presently preferred embodiments of accessory in accordance with the invention will now be described by way of example and with reference to the accompanying drawings, in which.

DESCRIPTION OF THE PREFERRED EMBODIMENTS

Figure 1:
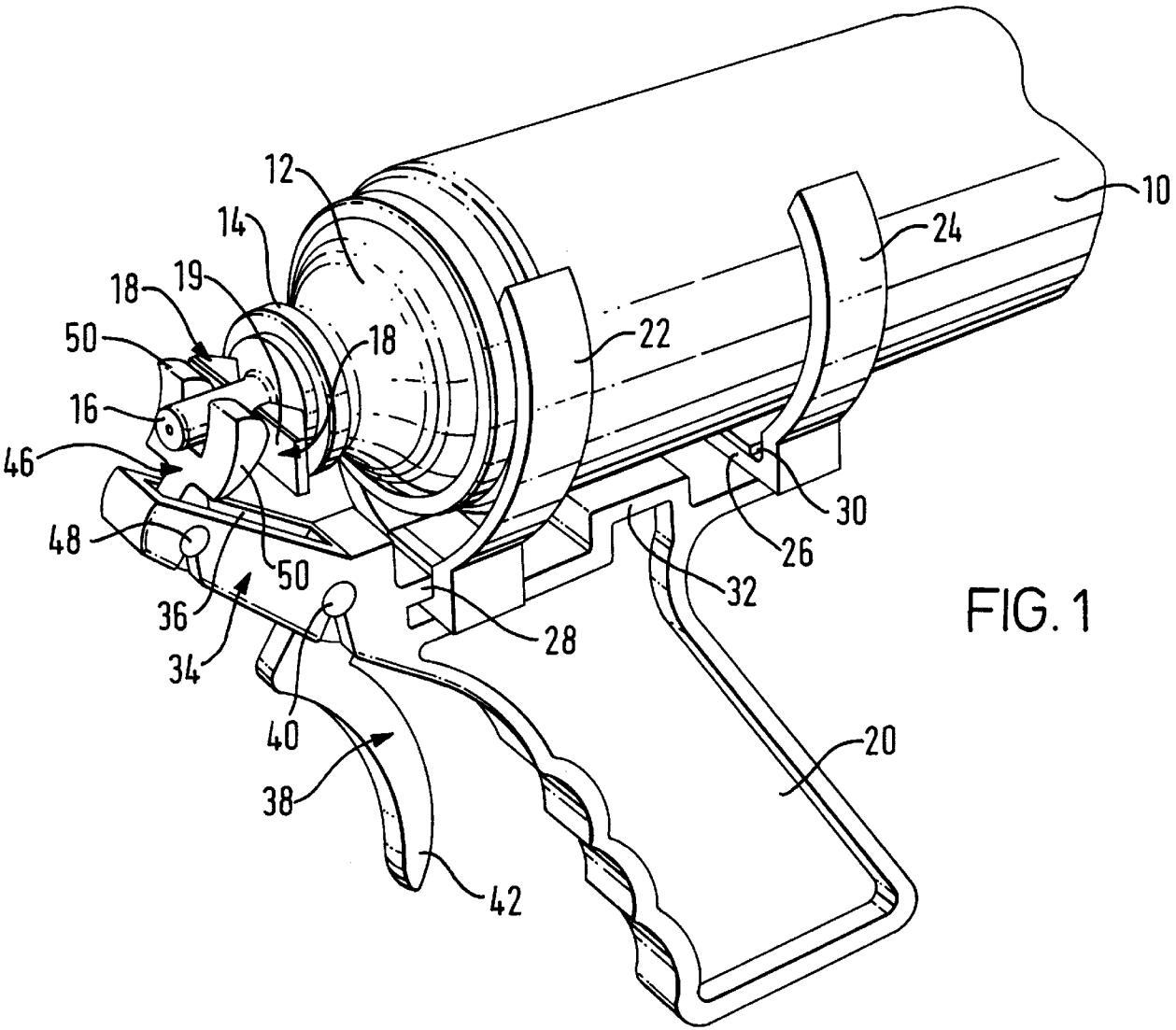
FIG. 1 is a perspective view of a first embodiment of the accessory attached to the upper end of an aerosol container.
Figure 2:
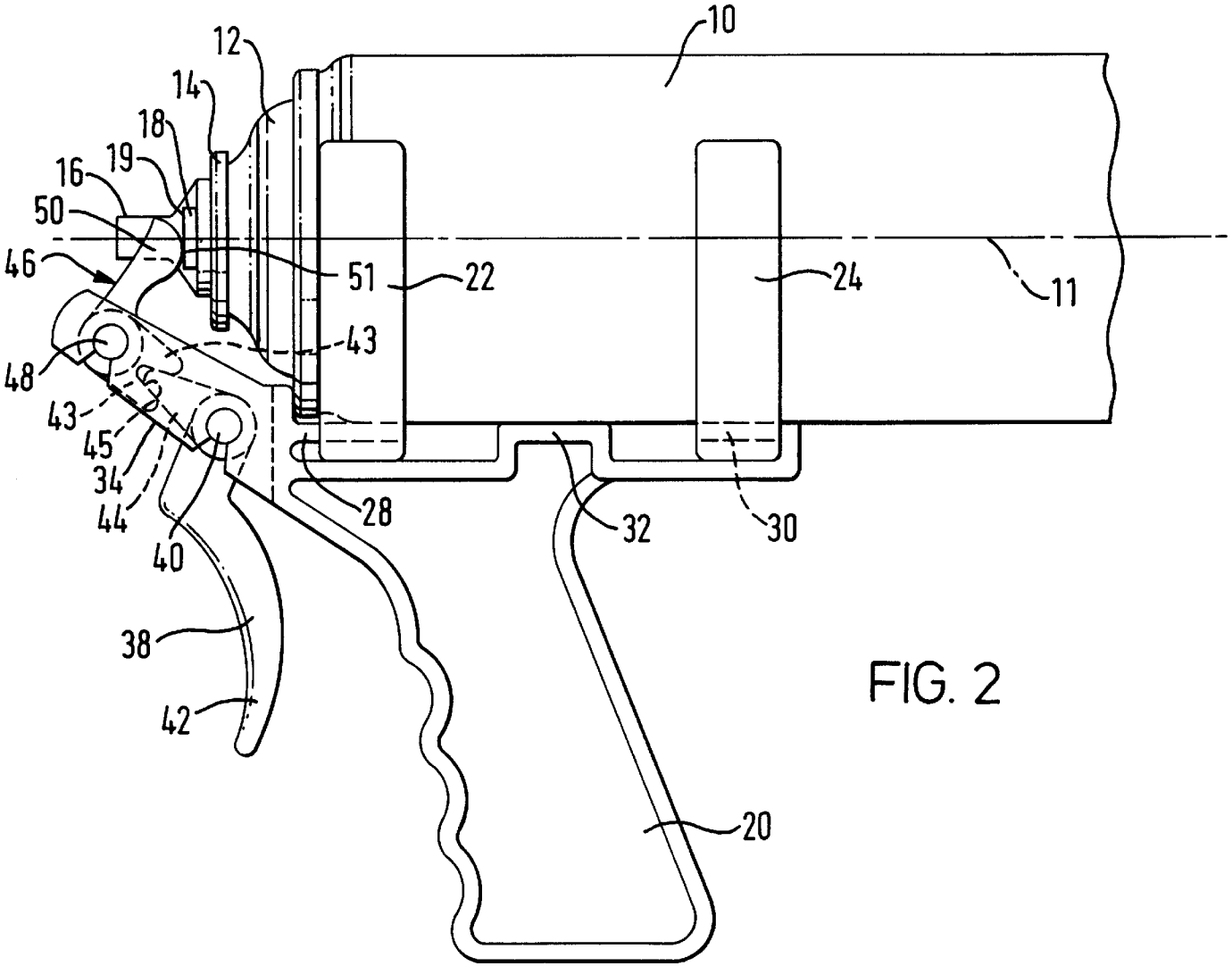
FIG. 2 is a schematic side elevation of the aerosol container and accessory of FIG. 1; and, FIG. 3 is a schematic side elevation of a modified embodiment of accessory, not showing the aerosol container.

Referring first to FIGS. 1 and 2, the aerosol container indicated generally at 10 comprises a cylindrical body having a domed end 12 with a neck ring 14 incorporating a nozzle 16. The longitudinal axis of the container is indicated at 11 in FIG. 2. The aerosol container 10 is a heavy duty container for contents such as bitumastic paints which can be used as line markings on sports grounds and other surfaces. Although the aerosol container 10 is shown in a horizontal attitude in the drawings, in use it is inverted for the spraying of the contents vertically downwards from the nozzle 16. In such aerosol containers the dip tube (not shown) within the container extends from the nozzle substantially the full length of the canister and then returns in a generally U-shaped configuration to terminate adjacent to the domed end 12 of the container. These aerosol containers also incorporate 360° valves as part of the dispensing mechanism.

In the embodiment shown in FIGS. 1 and 2 of the drawings, the nozzle 16 incorporates two wedge-shaped members 18 which are set diametrically opposite one another on opposite sides of the nozzle outlet. These wedge-shaped members 18 provide respective flat surfaces 19 facing outwardly from the container and against which pressure can be exerted to depress the valve and trigger the dispensation of the contents. It is to be noted that the nozzles of such aerosol containers vary in terms of their structure, but the mechanism of the present invention is designed to be effective for nozzles of widely varying types.

The accessory which is used with the aerosol container 10 has the dual function of enabling the container 10 to be held in the correct attitude for dispensation of the contents, and for actuating the valve mechanism in a simple, effective and reliable way so as to facilitate the spraying of the product.

The accessory comprises a grip portion 20 which has the general shape of a pistol grip. The upper part of the grip 20 is specially shaped to receive two clips, a leading clip 22 and a trailing clip 24. Each clip has a degree of resilience to enable it to locate and hold the container 10 within the clip arms which extend partially around the container. At the base junction of the two arms of each clip 22, 24 the clip has a relatively thin bridge portion 26 which is shaped and dimensioned to locate beneath and be retained by a projecting web 28, 30 of the grip. The projecting webs 28 and 30 define slots into which the bridge portions 26 of the clips are received by sliding the clips along the axis 11 into place on the grip. Between the two projecting web portions 28 and 30 the grip is shaped to define a central support 32, the upper surface of which is at the same level as the upper surfaces of the web portions 28 and 30 so that all three can support the wall of the aerosol container 10. This is shown more clearly in the modified embodiment shown in FIG. 3. The clips 22 and 24 are fitted to the grip by positioning the clips initially adjacent to the central support 32 and then sliding them, one forwards and one backwards, into the respective slots until they take up the position as shown in the drawings. To assist in the location of the clips within the slots, the underside of the projecting end of each web portion 28, 30 can be provided with a small bead 31 (FIG. 3)in order to resist removal of the clips while still permitting their removal if intentional.

The leading clip 22 is provided with a bead (not shown) around the contour of each clip arm on the inside of the clip at the leading edge thereof. The two arcuate beads which are thus provided assist in the location of the aerosol container 10 within this clip. The arcuate beads locate in the peripheral groove which runs around the aerosol container immediately behind the dome portion 12.

The cradle which is thus formed by the clips 22 and 24 and the grip 20 provides a secure mounting for the aerosol container 10 which can either be fitted to the clips by being inserted axially, first through the trailing clip 24 and then through the leading clip 22, or alternatively by being snapped into position by a radial movement of the container into the clips. The container is fully supported by the cradle. The making of the clips 22, 24 as items separate from the grip 20 facilitates the manufacture of the accessory. All three parts are of substantially the same thickness and can be made by moulding techniques. The parts of the accessory are preferably made of glass reinforced nylon material, although other materials could alternatively be used. Glass reinforced nylon has strength and resilience.

The actuating mechanism for the aerosol valve will now be described, first with reference to FIGS. 1 and 2. The accessory includes an arm 34 at its leading end which projects upwardly from the grip portion 20 at an angle of about 45°. This arm 34 is provided with a slot 36 therethrough, with the slot being closed at both the forward end and the rearward end. A trigger 38 is pivotally mounted in the arm 34 by means of a pivot pin 40. The trigger 38 is a double-armed lever having a relatively long lower limb 42 and a shorter upper limb 44 which is shaped in the manner of a nose. This nose 44 of the trigger 38 engages as a cam within a generally V-shaped recess 45 between fingers 43 of a pivotally mounted toggle 46. The toggle 46 is mounted on a pivot pin 48 which is received in the arm 34. The portion of the toggle 46 which lies on the opposite side of the pivot pin 48 to the fingers 43 which receive the nose 44 is shaped as a fork having two prongs 50 which are positioned one on each side of the nozzle 16 of the container and which have respective thrust surfaces 51 for engagement with the flat surfaces 19 of the wedge-shaped valve members 18.

As will be appreciated from the drawings, movement of the trigger 38 towards the grip 20 in a generally horizontal movement to the right by a squeezing movement will cause anti-clockwise movement of the nose 44 of the trigger and clockwise rotation of the toggle 46 about the pin 48, resulting in a generally horizontal movement of the thrust surfaces 51, also to the right, and causing pressure to be exerted by the thrust surfaces 51 against the surfaces 19 of the wedge-shaped members 18. It is to be noted that by the use of this lever and cam mechanism, a movement of the trigger 38 in one direction, i.e. to the right as shown in FIG. 2, results in movement of the prongs 50 in the same direction, i.e. also to the right as shown in FIG. 2.

The lever and cam mechanism can of course include spring means to restore the trigger 38 to its inoperative position. Such spring means are not shown in the drawings. It is also to be noted that the shape and dimensions of the toggle 46 can vary, depending upon the shape and dimensions of the nozzle portion of the container. The toggle 46 can be made detachable from the arm 34 so as to be interchangeable with other types of toggle, for use with different designs of container. The hand grip 20 projects generally radially outwardly from the container axis 11, and the trigger 42 in its inoperative position also projects generally radially outwardly from the container axis 11. In use, with the container 10 supported in the cradle, the longitudinal axis 11 of the container lies generally parallel to the forearm of the person handling the product.

Figure 3:
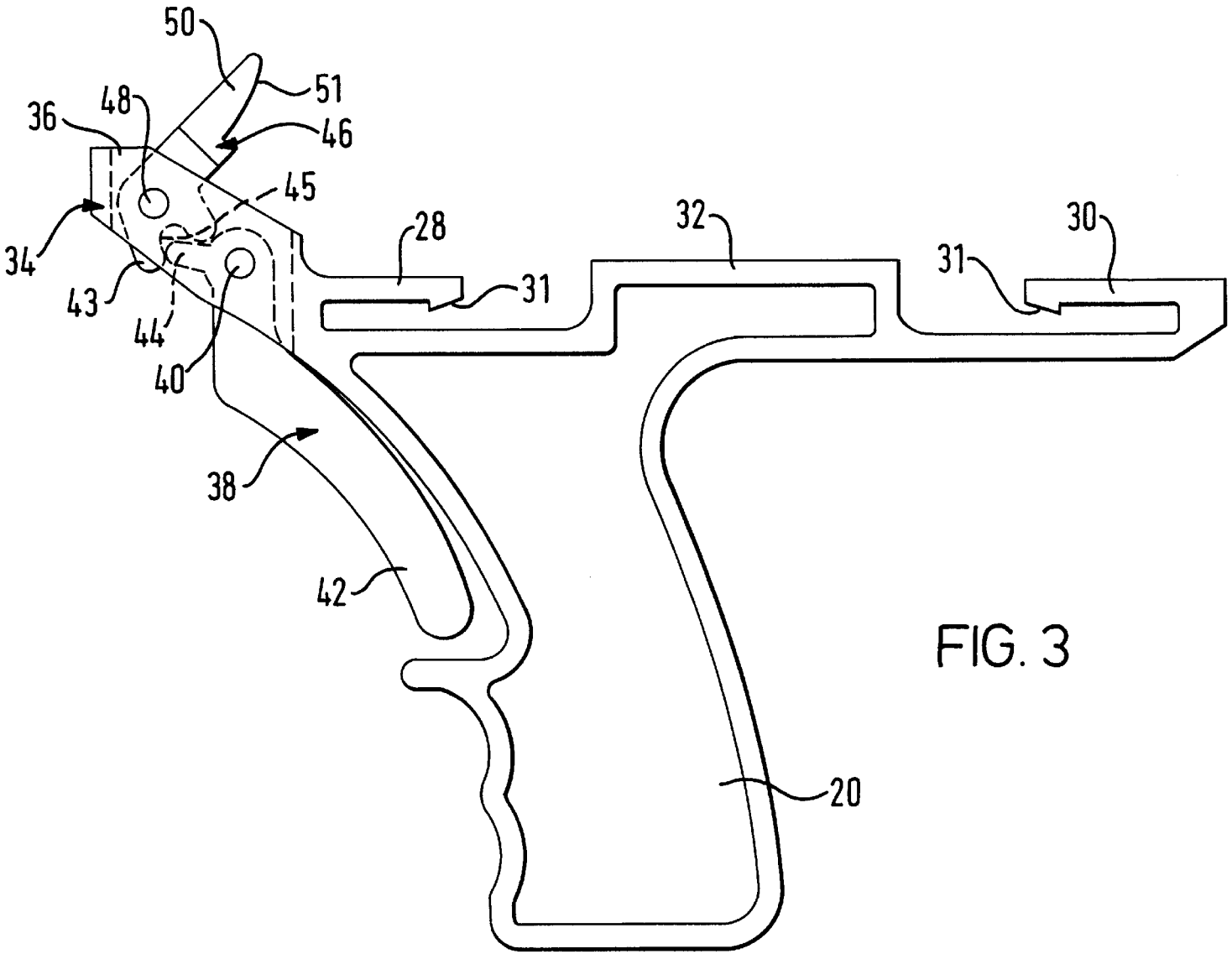

Referring now to FIG. 3, this shows a slightly modified hand grip 20 where the first double-armed lever comprises the trigger 42 and a differently shaped nose 44 which has substantially parallel sides as compared with the generally triangular nose 44 of FIG. 2. The toggle 46 is also slightly differently shaped. The thrust surfaces 51, or thrust surface if only one is provided, is more linear than in the first embodiment to provide increased contact with the surface or surfaces 19.

In each embodiment the movement of the trigger is communicated indirectly to the force-receiving surface or surfaces 19 of the valve mechanism, i.e. via the lever and cam mechanism, thereby giving a sensitive action with optimisation of forces and reliability of operation.

While the present invention has been described with reference to particular embodiments, those skilled in the art will recognise that many changes may be made thereto without departing from the spirit and scope of the present invention.

What is claimed is:

1. An accessory for dispensing the contents of an aerosol container, comprising support means for the container, a manually operable trigger which is displaceable and pivotable relative to the support means, the trigger including a double-armed lever having a first arm which is a trigger arm and a second arm which is formed as a nose, and a lever mechanism that is pivotally displaceable by movement of the trigger and includes a double-arm lever having a first arm and a second arm, the second arm of the trigger being in camming engagement with the first arm of the lever mechanism, the nose of the second arm of the trigger being engageable between fingers defined by the first arm of the lever mechanism, and the second arm of the lever mechanism having at least one thrust surface for engagement with a valve-actuating mechanism of the container, the trigger and lever mechanism being arranged such that movement of the trigger in a direction to actuate the valve produces a movement of said at least one thrust surface in substantially the same direction.

2. An accessory as claimed in claim 1, in which two thrust surfaces are provided, one arranged to act on each side of a nozzle of the container.

3. An accessory as claimed in claim 1, in which the support means comprises a cradle for a generally cylindrical container having a longitudinal axis, a hand-grip is connected to the cradle and projects generally radially outwardly from said container axis, and the trigger in its inoperative position also projects generally radially outwardly from said container axis.

4. An accessory as claimed in claim 3, in which, in use, with a container supported in the cradle, the longitudinal axis of the container lies generally parallel to the forearm of the user.

5. An accessory as claimed in claim 3, in which the cradle comprises two clips each subtending a pair of arcuate arms engageable around the container, with the clips each being detachably connected to the hand-grip.

6. An accessory as claimed in claim 5, in which the clips are each slidable into retained engagement with the hand-grip.

7. The combination of an accessory as claimed in claim 1 and an aerosol container intended for use in an inverted attitude.

8. An accessory for dispensing the contents of an aerosol container, comprising:

support means for the container, a manually operable trigger which is displaceable relative to the support means, the trigger having a first arm for engagement by a user and a second arm; and a lever mechanism in engagement with the trigger comprising (i) two thrust surfaces for engagement with a valve-actuating mechanism of the container, the two thrust surfaces being arranged to act one on each side of a nozzle of the container and (ii) at least one finger coupled to the thrust surfaces and being disposed so that the trigger second arm can engage the at least one finger, the trigger and lever mechanism being arranged such that movement of the trigger first arm in a direction to actuate the valve causes movement of the trigger second arm, which moves the at least one finger to produce movement of said thrust surfaces in substantially the same direction as the trigger first arm.

* * * * *